US007969388B2

(12) United States Patent
Takeda et al.

(10) Patent No.: US 7,969,388 B2
(45) Date of Patent: Jun. 28, 2011

(54) PLASMA DISPLAY DEVICE

(75) Inventors: Minoru Takeda, Osaka (JP); Hidehiko Shoji, Osaka (JP)

(73) Assignee: Panasonic Corporation, Osaka (JP)

( * ) Notice: Subject to any disclaimer, the term of this patent is extended or adjusted under 35 U.S.C. 154(b) by 493 days.

(21) Appl. No.: 11/660,646

(22) PCT Filed: Apr. 26, 2006

(86) PCT No.: PCT/JP2006/008723

§ 371 (c)(1),
(2), (4) Date: Feb. 21, 2007

(87) PCT Pub. No.: WO2006/115269

PCT Pub. Date: Nov. 2, 2006

(65) Prior Publication Data

US 2007/0252787 A1 Nov. 1, 2007

(30) Foreign Application Priority Data

Apr. 26, 2005 (JP) ..... 2005-127444

(51) Int. Cl.
*G09G 3/28* (2006.01)

(52) U.S. Cl. ..... 345/63; 345/68

(58) Field of Classification Search ..... 345/60–72; 313/581–587; 315/169.4
See application file for complete search history.

(56) References Cited

U.S. PATENT DOCUMENTS

| | | | | |
|---|---|---|---|---|
| 6,294,875 | B1 * | 9/2001 | Kurata et al. | 315/169.1 |
| 6,459,212 | B2 * | 10/2002 | Tokunaga et al. | 315/169.4 |
| 2003/0030598 | A1 | 2/2003 | Kanazawa et al. | 345/60 |
| 2004/0239593 | A1 | 12/2004 | Yamada | 345/63 |
| 2005/0212723 | A1 * | 9/2005 | Chung et al. | 345/60 |
| 2005/0259042 | A1 * | 11/2005 | Lee | 345/63 |

FOREIGN PATENT DOCUMENTS

| | | |
|---|---|---|
| CN | 1554081 | 12/2004 |
| JP | 2000-242224 | 9/2000 |
| JP | 2003-50562 | 2/2003 |
| JP | 2003-91258 | 3/2003 |
| JP | 2005-4044 | 1/2005 |

* cited by examiner

*Primary Examiner* — Jimmy H Nguyen
(74) *Attorney, Agent, or Firm* — Wenderoth, Lind & Ponack, L.L.P.

(57) ABSTRACT

Initialization waveforms with different voltages are applied respectively to a predetermined subfield with a small number of sustain pulses, and a subfield with the smallest number of sustain pulses in subfields other than the predetermined subfield. This offers a plasma display device that achieves a correct write operation in all discharge cells even if discharge interference occurs between adjacent cells, and also achieves a high contrast.

6 Claims, 5 Drawing Sheets

FIG. 2

| | SF1 | SF2 | SF3 | SF4 | SF5 | SF6 | SF7 | SF8 |
|---|---|---|---|---|---|---|---|---|
| Grayscale/ number of pulses | 1 | 2 | 4 | 16 | 64 | 8 | 32 | 128 |
| 0 | | | | | | | | |
| 1 | O | | | | | | | |
| 2 | | O | | | | | | |
| 3 | O | O | | | | | | |
| 4 | | | O | | | | | |
| 5 | O | | O | | | | | |
| 6 | | O | O | | | | | |
| 7 | O | O | O | | | | | |
| 8 | | | | | | O | | |
| 9 | O | | | | | O | | |
| 10 | | O | | | | O | | |
| 11 | O | O | | | | O | | |
| 12 | | | O | | | O | | |
| 13 | O | | O | | | O | | |
| 14 | | O | O | | | O | | |
| 15 | O | O | O | | | O | | |
| 16 | | | | O | | | | |
| 17 | O | | | O | | | | |
| ⋮ | | | | | | | | |
| 251 | O | O | | O | O | O | O | O |
| 252 | | | O | O | O | O | O | O |
| 253 | O | | O | O | O | O | O | O |
| 254 | | O | O | O | O | O | O | O |
| 255 | O | O | O | O | O | O | O | O |

O···· ON

PLASMA DISPLAY DEVICE

This Application is a U.S. National Phase Application of PCT International Application PCT/JP2006/308723.

TECHNICAL FIELD

The present invention relates to plasma display devices for displaying images by controlling discharge.

BACKGROUND ART

In a surface-discharge AC panel, which is a typical plasma display panel (hereafter "panel"), numerous discharge cells are formed between a front panel and rear panel facing each other. In the front panel, display electrodes, respectively consisting of a pair of scan electrode and sustain electrode, are disposed parallel to each other on a front glass substrate, and they are covered with a dielectric layer and a protective layer. In the rear panel, data electrodes are disposed parallel to each other on a rear glass substrate, and they are covered with a dielectric layer. Barrier ribs are formed parallel to data electrodes, and a phosphor layer is formed on the surface of the dielectric layer and a side face of the barrier ribs. Then, the front panel and the rear panel are disposed facing each other in a way such that the display electrodes and the data electrodes are orthogonal to each other, and sealed. Discharge gas is filled in a discharge space inside. Discharge cells are created at areas where display electrodes and data electrodes face each other. In the panel as configured above, ultraviolet rays are generated by discharging gas inside each discharge cell. These ultraviolet rays excite and make RGB phosphors emit light so as to achieve color display.

For driving the panel, a subfield method is generally used. More specifically, a one-field period is divided into multiple subfields, and grayscale images are displayed by the combination of subfields to emit light. In the subfield method, a new drive method is disclosed in Unexamined Japanese Patent Publication No. 2000-242224. This method is to suppress an increase in luminance of black level by extremely reducing luminescence not related to the grayscale display so as to improve the contrast.

The subfield method is briefly described below. Each subfield includes an initialization period, write period, and sustain period. In the initialization period, either all-cell initialization or selective initialization takes place. The all-cell initialization is to generate initialization discharge in all discharge cells that display images, and selective initialization is to generate initialization discharge selectively only in discharge cells where sustain discharge is generated in a preceding subfield.

In the all-cell initialization period, initialization discharge is generated at once in all discharge cells for erasing a past record of wall charge in each discharge cell and forming a wall charge needed for a subsequent write operation. The initialization discharge also acts to generate priming (spark for discharge=priming particle) for reducing discharge delay so as to stabilize write discharge. In the selective initialization period, a wall charge required for the write operation is formed in a discharge cell where sustain discharge has been generated in a preceding subfield. In a subsequent write period, a scan pulse is applied sequentially to the scan electrodes, and a write pulse corresponding to a picture signal for display is applied to the data electrodes so that selective write discharge is induced between the scan electrodes and data electrodes for selectively forming the wall charge. In the sustain period, a sustain pulse is applied between the scan electrodes and sustain electrodes for a predetermined number of times corresponding to each level of brightness weight so that discharge cells where the wall charge is formed by write discharge are selectively discharged for luminescence. By reducing the number of subfields undergoing all-cell initialization, luminescence not related to grayscale expression can be reduced for suppressing the increase in luminance of the black level.

Here, it is important to ensure reliable selective write discharge in the write period for displaying images correctly. However, there are many factors that significantly delay a write discharge: No high voltage is applicable to the write pulse due to restrictions of the circuit configuration, the phosphor layer formed on the data electrodes hinders discharge, and so on. Accordingly, priming for reliably generating a write discharge is extremely important.

In the plasma display device, the wall charge that is stored in an off-cell weakens due to write discharge and/or luminescence sustain discharge in an on-cell because discharge interference occurs between these discharge cells if the adjacent cells are an on-cell and off-cell in a specific subfield. As a result, in the discharge cell with weakened wall charge, the sum of the pulse voltage applied to each electrode in the write period of a subsequent subfield and wall charge falls to below the discharge start voltage. This hinders a correct write operation, and the predetermined discharge cell becomes a dark spot, notably deteriorating picture quality.

The degree of weakening of wall charge by discharge interference between adjacent cells is proportional to the number of luminescence sustain operations. Accordingly, the wall charge is more apparently weakened in subfields with large weight. This discharge cell with weakened wall charge as described above cannot recover its correct write and luminescence sustain operations until one entire field is completed, and this causes deterioration of picture quality.

The present invention counteracts this disadvantage, and offers a plasma display device that ensures correct write operation and high contrast.

SUMMARY OF THE INVENTION

In a plasma display device of the present invention, one field is configured with multiple subfields including at least a luminescence sustain period. In addition, one field includes at least one set of successive subfields with a large number and then small number of sustain pulses, respectively, applied to a scan electrode in the luminescence sustain period. Initialization waveforms with different voltages are applied respectively to a predetermined subfield with the small number of sustain pulses and a subfield with the smallest number of sustain pulses in the subfields excluding this predetermined subfield.

With this structure, a write operation can be correctly executed in all discharge cells without degrading the contrast even if discharge interference occurs between adjacent cells or if a subfield with small weight is disposed far timewise from the initialization period.

Still more, in the subfields of one field, the voltage of the initialization waveform applied to a subfield with the smallest number of sustain pulses, excluding the predetermined subfield, is higher than the voltage of the initialization waveform applied to other subfields.

Still more, the voltage of initialization waveform is determined in proportion to the level of input picture signal.

Furthermore, the present invention includes an initialization voltage determination unit for determining the voltage of initialization waveform in proportion to the level of input picture signal.

This makes it possible to minimize changes in the black level due to initialization discharge in response to continuously changing signals. Accordingly, deterioration of contrast is preventable and the display screen flicker can be minimized.

With the present invention, the write operation can be correctly executed in all discharge cells without degrading the contrast even if discharge interference occurs between adjacent cells or a subfield with small weight is disposed far timewise from the initialization period.

Different voltages of initialization waveforms are determined depending on the level of input picture signal, and the present invention includes the initialization voltage determination unit for determining the voltage of initialization waveform in proportion to the level of input picture signal. This enables minimization of changes in the black level due to initialization discharge in response to continuously changing signals. Accordingly, the present invention prevents deterioration of contrast and also minimizes the display screen flicker.

BRIEF DESCRIPTION OF THE DRAWINGS

FIG. 2 illustrates a grayscale expression method of the plasma display device.

REFERENCE MARKS IN THE DRAWINGS

Figure 1:
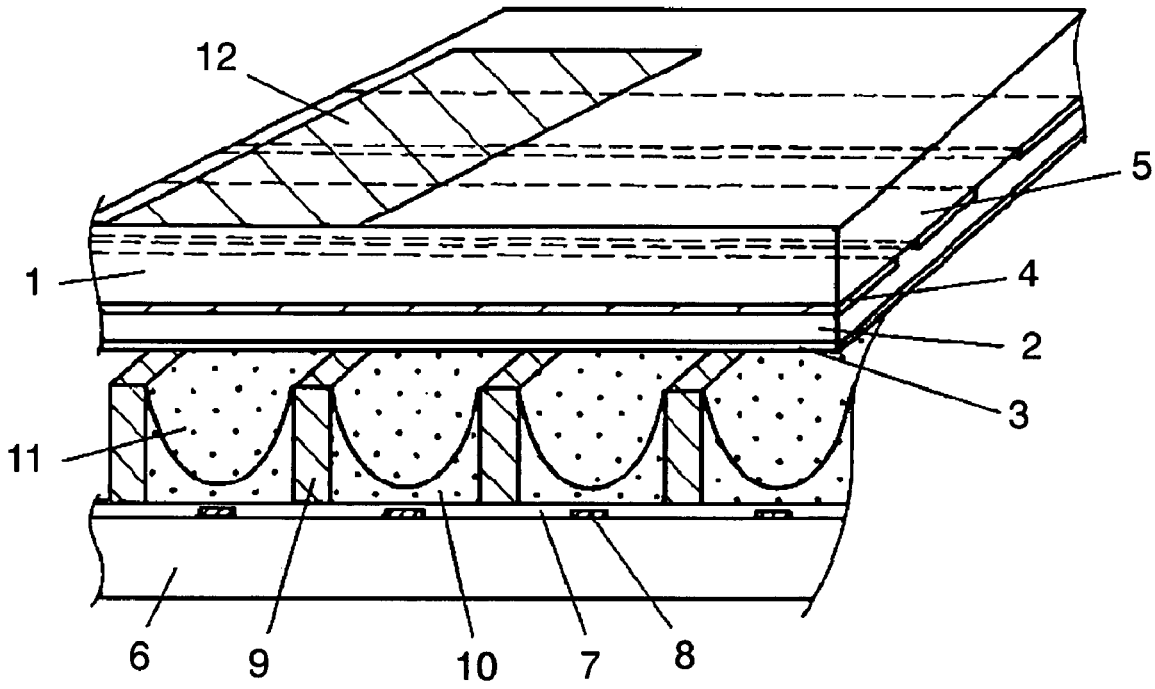
FIG. 1 is a perspective view of a structure of a plasma display panel.

4 Scan electrode
5 Sustain electrode
8 Data electrode
12 Discharge cell
20 Signal level detector
30 Subfield converter
40 Initialization voltage determination unit
100 Plasma display panel
200 Data driver
300 Scan driver
400 Sustain driver

DETAILED DESCRIPTION OF THE PREFERRED EMBODIMENTS

Exemplary Embodiment

A plasma display device in an exemplary embodiment of the present invention is described below with reference to FIGS. 1 to 5.

First, a panel structure is described with reference to FIG. 1. As shown in FIG. 1, a pair of scan electrode 4 and sustain electrode 5 are disposed in parallel on first glass substrate 1, and covered with dielectric layer 2 and protective layer 3. Data electrodes 8 are disposed on second glass substrate 6, and covered with insulating layer 7. Barrier ribs 9 are disposed on insulating layer 7 between data electrodes 8 in a way such that barrier ribs 9 are parallel to data electrodes 8. Phosphor 10 is provided on the surface of insulating layer 7 and a side face of barrier ribs 9. First glass substrate 1 and second glass substrate 6 are disposed facing each other with discharge space 11 in between in a way such that scan electrode 4 and sustain electrode 5 are orthogonal to data electrodes 8. Discharge gas is filled in discharge space 11. Discharge cell 12 is configured in a discharge space between two adjacent barrier ribs 9 and an intersection between data electrode 8 and scan electrode 4 and sustain electrode 5 facing data electrodes 8.

FIG. 2 indicates a grayscale expression method of the plasma display device. Since the plasma display device uses the discharge phenomenon, discharge cell 12 has only two states: Light ON and OFF. Accordingly, for expressing intermediate grayscales, one field is divided into subfields and a brightness weight is assigned to each subfield. The luminescence of each field is controlled to permit grayscale expression. For example, as shown in FIG. 2, one field is divided into eight subfields, and brightness weights of "1," "2," "4," "16," "64," "8," "32," and "128" are assigned to subfields SF1 to SF8, respectively. For displaying grayscale "15," a write operation is executed in SF1, SF2, SF3, and SF6 during the write period so as to execute a luminescence sustain operation equivalent to "1," "2," "4," and "8," which are the weights assigned to these subfields for expressing grayscale "15." For expressing grayscale "16," the write operation takes place only in SF4 so as to execute the luminescence sustain operation equivalent to grayscale "16."

Figure 3:
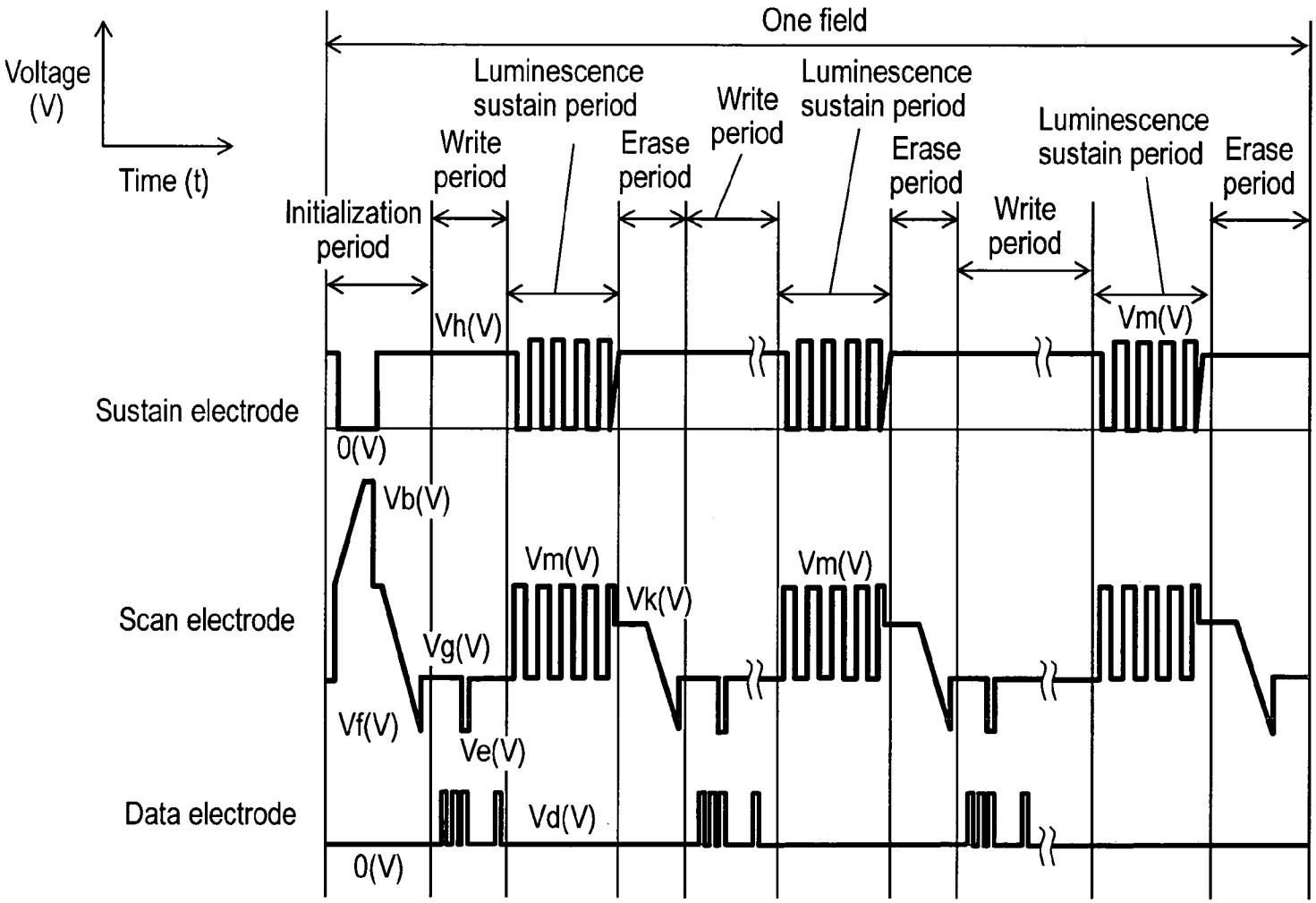
FIG. 3 is a drive voltage waveform chart of the plasma display device.

FIG. 3 illustrates a drive voltage waveform in one field for driving the plasma display device. As shown in FIG. 3, one field consists of several subfields, and each subfield includes the write period, luminescence sustain period, and erase period. One field is configured with an initialization period at the beginning, followed by subfields. The operation in the initialization period and each subfield is described next.

In initialization during the initialization period, as shown in FIG. 3, all data electrodes and sustain electrodes are retained at 0, and a lamp voltage which gradually increases from a voltage lower than the discharge start voltage toward voltage Vb (V) higher than the discharge start voltage is applied to all scan electrodes with respect to all sustain electrodes. While this lamp voltage is rising, a faint discharge is generated for the first time from all scan electrodes to all data electrodes and all sustain electrodes in all discharge cells 12 regardless of the discharge state and storage state of wall charge up to the preceding step. A negative wall voltage is stored on the surface of protective film 3 on all scan electrodes, and a positive wall voltage is stored on the surface of protective film 3 on all sustain electrodes.

As a result, all sustain electrodes are retained at positive voltage Vh (V); and the lamp voltage, which gradually decreases toward voltage Vf (V) above the discharge start voltage with respect to all sustain electrodes, is applied to all scan electrodes. While this lamp voltage is decreasing, a faint discharge is generated for the second time from all sustain electrodes to all scan electrodes in all discharge cells. The negative wall voltage stored on the surface of protective film 3 on all scan electrodes and the positive wall voltage stored on the surface of protective film 3 on all sustain electrodes are both weakened. A faint discharge is also generated between all data electrodes and all scan electrodes, and the positive wall voltage stored on the surface of insulating layer 7 on all data electrodes is adjusted to a value effective for the write operation in a subsequent write period. This completes initialization during the initialization period.

Then, in the write period which is a period immediately after the initialization period, all sustain electrodes are retained at Vh (V) and all scan electrodes are retained at Vg (V). Positive write pulse voltage Vd (V) is applied to a predetermined data electrode corresponding to discharge cell 12 to be displayed in the first line in all data electrodes, and scan pulse voltage Ve (V) is applied to the scan electrode in the first line. The voltage between the surface of insulating layer 7 and the surface of protective film 3 on the scan electrodes at an intersection of the predetermined data electrode and scan electrode is the sum of write pulse voltage Vd (V) and the positive wall voltage stored on the surface of insulating layer 7 on all data electrodes in preceding initialization. Accordingly, a write discharge is respectively generated between the predetermined data electrode and scan electrode and between the sustain electrode and scan electrode at this intersection. Accordingly, the positive wall voltage is stored on the surface of protective film 3 on the scan electrode, the negative wall voltage is stored on the surface of protective film 3 on the sustain electrode, and the negative wall voltage is stored on the surface of insulating layer 7 on the data electrode at this intersection. The same operation takes place in all data electrodes, and the write operation in the write period completes.

The luminescence sustain operation in the luminescence sustain period following the write operation is described next. In the luminescence sustain period, all scan electrodes and sustain electrodes are first retained at 0 (V), after which positive sustain pulse voltage Vm (V) is applied to all scan electrodes. Consequently, the voltage between the surface of protective film 3 on scan electrodes 4 and the surface of protective film 3 on sustain electrode 5 in discharge cell 12 where write discharge has been generated becomes the sum of sustain pulse voltage Vm (V), and the positive wall voltage stored on protective film 3 on the scan electrode 4 and the negative wall voltage stored on the surface of protective film 3 on sustain electrode 5 stored during the write period. This voltage exceeds the discharge start voltage. Accordingly, a sustain discharge is generated between scan electrode 4 and sustain electrode 5 in discharge cell 12 where write discharge has taken place. The negative wall voltage is stored on the surface of protective film 3 on scan electrodes 4, and the positive wall voltage is stored on the surface of protective film 3 on sustain electrode 5 in discharge cell 12 where this sustain discharge has taken place. Sustain pulse voltage then returns to 0 (V).

Next, when positive sustain pulse voltage Vm (V) is applied to all sustain electrodes, the voltage between the surface of protective film 3 on scan electrode 4 and the surface of protective film 3 on sustain electrode 5 in discharge cell 12 where sustain discharge has taken place becomes the sum of sustain pulse voltage Vm (V), and the negative wall voltage on the surface of protective film on scan electrode 4 and the positive wall voltage on the surface of protective film 3 on sustain electrode 5 stored in preceding sustain discharge. Accordingly, sustain discharge is generated between scan electrode 4 and sustain electrode 5 in discharge cell 12 where sustain discharge has taken place immediately before. The positive wall voltage is stored on the surface of protective film 3 on scan electrode 4, and the negative wall voltage is stored on the surface of protective film 3 on sustain electrode 5 in discharge cell 12 where this sustain discharge has taken place. Then, the sustain pulse voltage returns to 0 (V). In the same way, sustain discharge continuously takes place by applying positive sustain pulse voltage Vm (V) to all scan electrodes and all sustain electrodes alternately. For cells in which the write operation did not take place in the preceding write period, no luminescence sustain operation is executed. During the luminescence sustain period, the luminescence sustain pulse for luminescence sustain corresponding to a weighted value of each subfield is applied to the scan electrode and sustain electrode. If the luminescence sustain operation takes place during the luminescence sustain period in a subfield whose brightness weight is "16," for example, luminance level 16 is achieved.

As described above, the initialization period is a period for storing wall charge which is effective during the subsequent write period in all discharge cells. The write period is a period for selecting discharge cells for emitting light. The luminescence sustain period is a period for sustaining luminescence for the number of times corresponding to the weight of each subfield. In other words, for example, if subfields from SF1 to SF8 in FIG. 2 are given the weights of "1," "2," "4," "16," "64," "8," "32," and "128," the luminance level in each discharge cell is from 0 to 255, allowing expression of all 256 grayscale shades.

Figure 4:
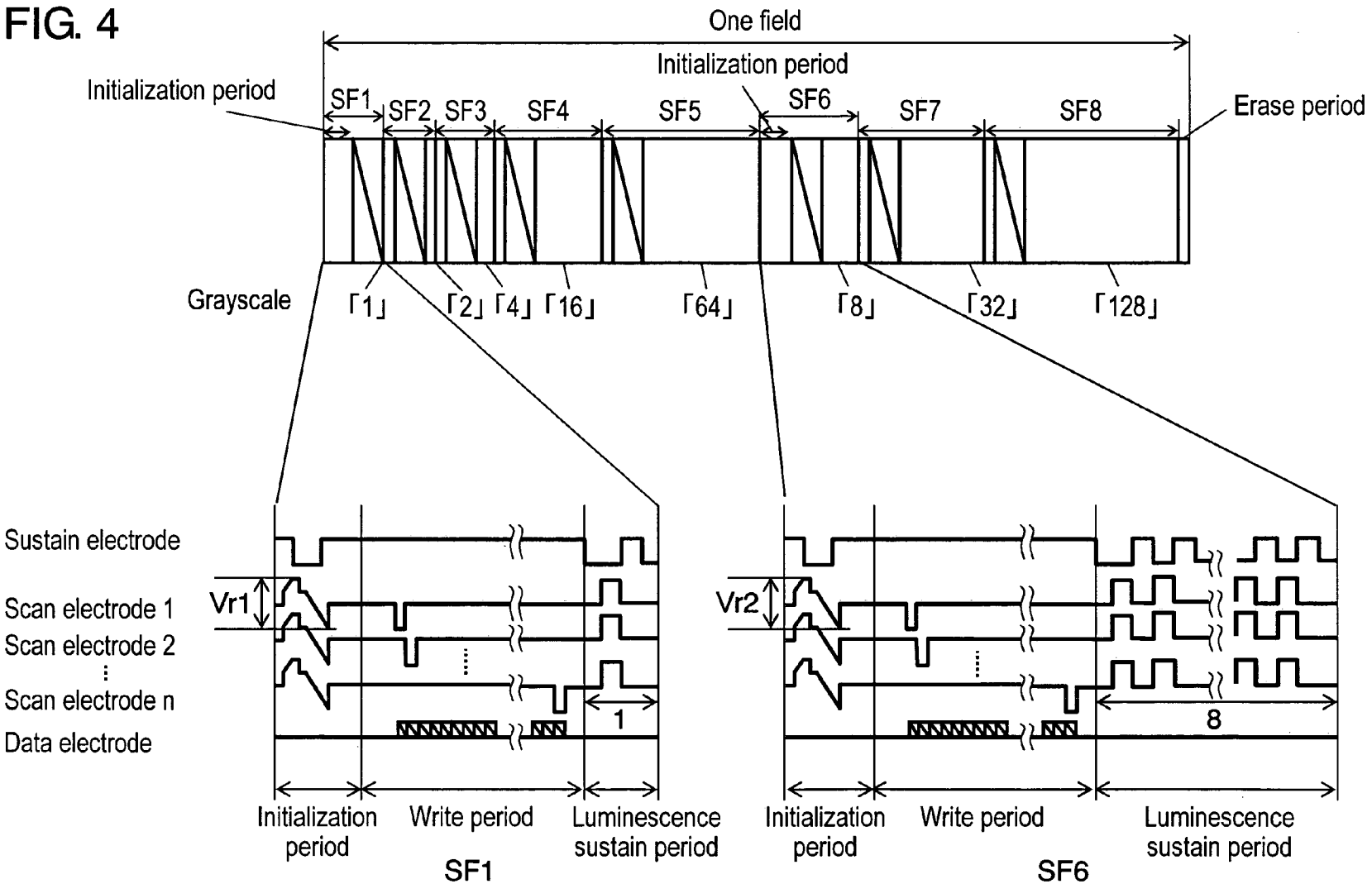
FIG. 4 illustrates time division and drive voltage waveform of a plasma display device in an exemplary embodiment of the present invention.

FIG. 4 shows the time division and drive voltage waveform of one field in the plasma display device in the exemplary embodiment of the present invention.

As shown in FIG. 4, one field consists of the initialization period provided at the beginning and between "SF5" and "SF6," and eight subfields. Each of these subfields consist of the write period, luminescence sustain period, and erase period.

As shown in FIG. 4, in the plasma display device of the present invention, one field includes at least one set of successive subfields with a large number and then a small number of sustain pulses, respectively, applied to the scan electrode in the luminescence sustain period. Initialization waveforms with different voltages are applied respectively to the first subfield with the small number of sustain pulses and a subfield with the smallest number of sustain pulses in the subfields configuring one field, excluding a predetermined subfield. The voltage of initialization waveform applied to the subfield with the smallest number of sustain pulses in the subfields configuring one field is higher than the voltage of initialization waveform applied to other subfields. This configuration is described below.

As shown in FIG. 4, all data electrodes and all sustain electrodes are retained at 0 (V) at the beginning of one field, and then initialization waveform voltage Vr1 is applied to all scan electrodes so as to generate the first faint discharge from all scan electrodes to all data electrodes and all sustain electrodes in all discharge cells regardless of the discharge state and the wall charge storage state up to the preceding step. As a result, the negative wall voltage is stored on the surface of protective film 3 on all scan electrodes and the positive wall voltage is stored on the surface of protective film 3 on all scan electrodes and the surface of protective film 3 on all sustain electrodes.

Then, all sustain electrodes are retained in the positive voltage, and the lamp voltage which gradually decreases toward the voltage above the discharge start voltage with respect to all sustain electrodes is applied to all scan electrodes. While this lamp voltage is decreasing, the second faint discharge is generated again in all discharge cells 12. The wall voltage stored in each electrode is adjusted to a value effective for the write operation in the subsequent write period. This completes initialization in the initialization period.

Next, in the write period of a subfield immediately after the initialization period, the wall voltage which is sufficient for the correct luminescence sustain operation in the subsequent luminescence sustain period is stored in each electrode only in the discharge cells to be lighted. This completes the write operation in the write period.

In the subsequent luminescence sustain period, the luminescence sustain operation takes place for the number of times corresponding to the weight assigned to each subfield only in the discharge cells where the write operation has taken place in the preceding write period. This achieves luminance corresponding to the weight, enabling grayscale expression.

When the write operation takes place in "SF2" in FIG. 2, the luminescence sustain operation equivalent to "2" which is the weight for "SF2" takes place. If the luminescence sustain operation takes place only in "SF2," expression of grayscale "2" is achieved.

For expressing grayscale "87" in predetermined discharge cell A in a certain field and grayscale "191" in discharge cell B right below discharge cell A on the panel, the write operation and the luminescence sustain operation are executed in "SF1," "SF2," "SF3," "SF4," and "SF5" in discharge cell A, and the write operation and the luminescence sustain operation are executed in all subfields from "SF1" to "SF8" except for "SF5" in discharge cell B.

At this point, same operations take place in discharge cell A and discharge cell B in all periods up to "SF1" to "SF4." However, in "SF5," the write operation and the luminescence sustain operation take place only in discharge cell A. In this case, discharge interference occurs in discharge cell B due to the write operation and the luminescence sustain operation in discharge cell A. This results in weakening the wall voltage stored in each electrode of discharge cell B, disturbing the correct write operation in the write period on and after "SF6." Accordingly, expression of extremely dark grayscale "23" is achieved instead of grayscale "191" which supposed to be achieved, causing significant deterioration in picture quality. However, provision of the initialization period immediately after "SF5" can reset the weakened wall voltage to the state appropriate for correct write operation, and thus the correct write operation is made feasible in "SF6." Deterioration of picture quality is thus preventable. In addition, the first initialization results in the presence of more charged particles compared to the case without initialization. Accordingly, all discharge cells can be correctly initialized for the second time using second initialization waveform voltage Vr2 which is lower than Vr1. This achieves a higher contrast because luminance by initialization discharge can be made smaller than would be effected by applying initialization waveform voltage Vr1 twice.

The degree of discharge interference depends on the scale of write discharge and the scale and number of times of luminescence sustain operation. Accordingly, in a subfield with relatively large weight, such as "SF5," discharge interference due to the luminescence sustain operation becomes large, and the wall charge stored in each electrode of discharge cell B until completion of all operations in the preceding subfield in the write period and luminescence sustain period of "SF5" is notably weakened. On the other hand, in a subfield with relatively small weight, such as "SF1" and "SF2," discharge interference due to the luminescence sustain operation is small. Accordingly, the correct write operation is achievable in the write period of subsequent subfields because the interference is small even though the wall charge stored in each electrode until completion of all operations in the preceding subfield is weakened.

If a subfield with relatively small weight, such as "SF6," is far timewise from the initialization period provided at the beginning of the field, the wall charge stored in each electrode gradually weakens, and the correct write operation is disturbed in the write period of "SF6" and subsequent subfields. This makes the predetermined discharge cell a dark spot, notably deteriorating picture quality. Also in this case, the wall charge, if it weakens, can be reset to the state appropriate for the correct write operation by providing an initialization period immediately after "SF5." In this way, correct write operation can also take place in "SF6," preventing deterioration of picture quality. Since a greater number of charged particles are present in all discharge cells due to the first initialization compared to that without initialization, correct initialization is achieved in all discharge cells using second initialization waveform voltage Vr2 which is lower than Vr1. In this case, a higher contrast is achieved because luminance by an initialization discharge can be made smaller than would be effected by applying Vr1 twice.

The number of subfields and the weight value of each subfield need not necessarily be those shown in FIG. 2. Weight values are assigned such that grayscale expression is feasible by the combination of sustain luminescence in the luminescence sustain period of each subfield. As long as successive subfields with large and then small weights, respectively, for the luminescence sustain period are present in each field, and the initialization period is provided immediately after the subfield with large weight, the same effect is achievable. In FIG. 4, the initialization waveform voltage is a positive voltage pulse applied to each scan electrode. However, a positive voltage pulse is not necessary. As long as it is the voltage used for initialization discharge between at least two electrodes in the initialization waveforms for initializing all cells regardless of the on and off states in the preceding step, the same effect is achievable.

Figure 5:
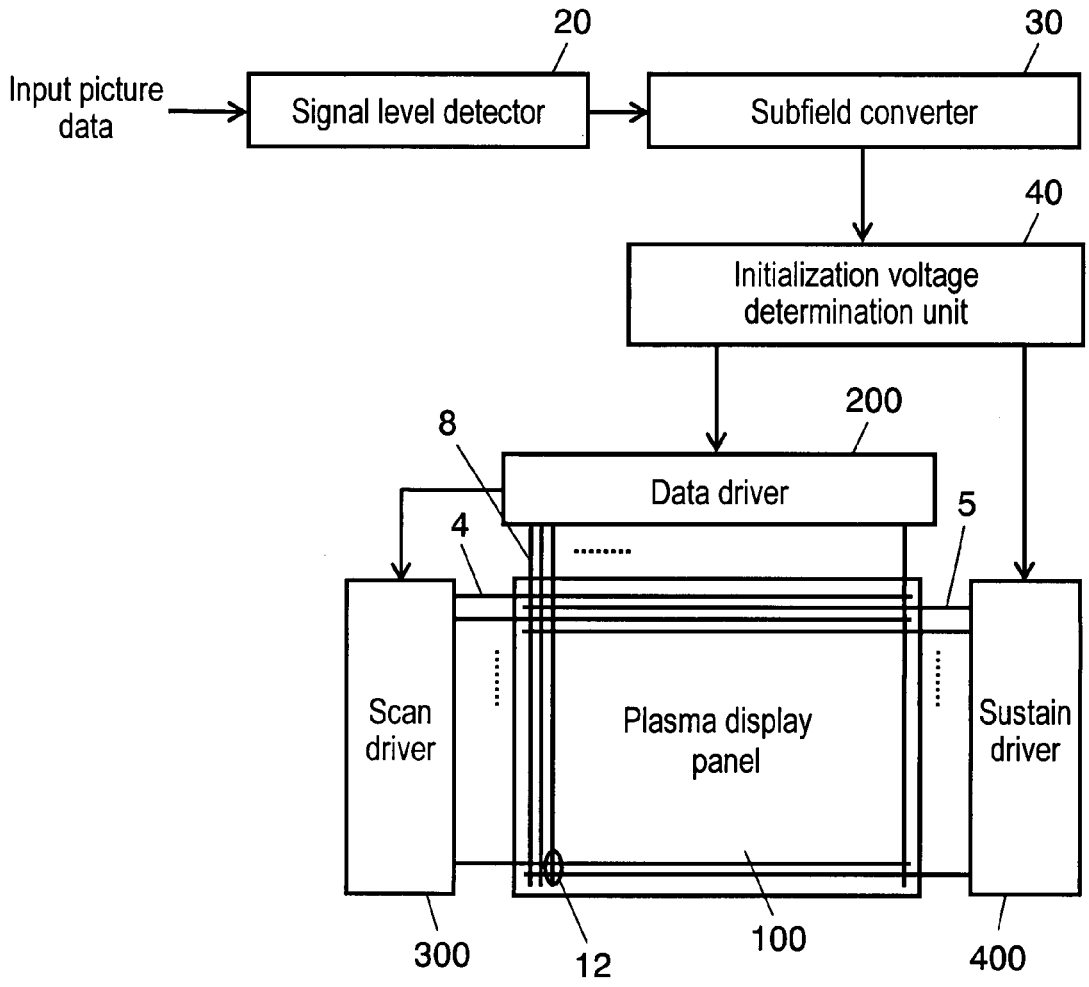
FIG. 5 is a block diagram of the plasma display device in the exemplary embodiment of the present invention.

FIG. 5 is a block diagram of the plasma display device in the exemplary embodiment of the present invention. The case of applying the initialization waveform twice in one field, and its voltage determined by the input picture signal level or an initialization voltage determination unit provided for determining the initialization waveform voltage depending on the input picture signal level is described.

The plasma display device in FIG. 5 includes panel 100, data driver 200, scan driver 300, sustain driver 400, signal level detector 20, subfield converter 30, and initialization voltage determination unit 40. In panel 100, scan electrodes 4 and sustain electrodes 5 are alternately disposed in parallel, and data electrodes 8 are disposed orthogonal to these electrodes.

Data driver 200, scan driver 300, and sustain driver 400 are coupled to panel 100. Signal level detector 20 is coupled to subfield converter 30, and receives input picture data. Subfield converter 30 is coupled to initialization voltage determination unit 40. Initialization voltage determination unit 40 is coupled to data driver 200, scan driver 300, and sustain driver 400. Signal level detector 20 detects an average luminance level and peak luminance of an input signal, and outputs its signal to subfield converter 30 together with signal level information. Subfield converter 30 determines a subfield to write in according to a grayscale of the input signal, and this information is output to initialization voltage determination unit 40 together with signal level information. Initialization voltage determination unit 40 determines a voltage to be applied to each electrode in the initialization period based on the signal level and lighting pattern of subfield, and outputs its information to data driver 200, scan driver 300, and sustain driver 400. Scan driver 300 respectively generates a pulse for initialization, luminescence sustain operation, write operation, and erase operation during the initialization period including luminescence sustain period, write period, and erase period of each subfield so that initialization discharge, write discharge, luminescence sustain discharge, and erase discharge are reliably generated in all discharge cells inside panel 100.

Sustain driver 400 respectively generates a pulse for initialization, luminescence sustain operation, write operation, and erase operation during the initialization period including luminescence sustain period, write period, and erase period of each subfield so that initialization discharge, write discharge, luminescence sustain discharge, and erase discharge are reliably generated in all discharge cells inside panel 100.

Next, data driver 200 generates a write voltage pulse for turning on and off depending on the picture signal received via subfield converter 30 in the write period of each subfield so that write discharge can be generated in all discharge cells inside panel 100. During the luminescence sustain period of each subfield, data driver 200 generates a voltage pulse acting on the sustain operation. This enables initialization, luminescence sustain operation, write operation, and erase and initialization in a predetermined discharge cell for displaying an image on panel 100.

For expressing grayscale "8" in FIG. 4, i.e., when only subfield "SF6" which has relatively small weight is lighted, sufficient write operation cannot take place only by initialization in the initialization period provided at the beginning of one field. Accordingly, the second initialization waveform is applied immediately before "SF6." However, in this case, the number of charge particles in the discharge cell is also small. For achieving the correct write operation in "SF6," second initialization waveform voltage Vr2 needs to be relatively close to first initialization waveform voltage Vr1, which is high voltage. Contrary, for expressing grayscale "31," i.e. when "SF1," "SF2," "SF3," "SF4," and "SF6" are lighted, many charge particles exist in the discharge cell through the write operation and luminescence sustain operation up to "SF1" to "SF4" in addition to initialization in the initialization period provided at the beginning of one field. Accordingly, second initialization waveform voltage Vr2 can be made apparently small compared to the case of expressing grayscale "8."

For executing sufficient write operation for all picture signals, second initialization waveform voltage Vr2 needs to be always relatively close to the voltage in the first initialization, which is high voltage. This will greatly degrade the contrast. However, changes in the black level due to initialization discharge can be minimized even if the voltage of initialization waveform is changed in response to consecutively changing signals by making second initialization voltage Vr2 variable depending on input signal data. Accordingly, deterioration of contrast is preventable and also the display screen flicker can be minimized.

The number of subfields and a weight value of each subfield need not necessarily be values shown in FIG. 4. As long as weight values allow expression in grayscales by combination of sustain luminescence in the luminescence sustain period of each subfield, as long as successive subfields with large weight and then small weight, respectively, are present in the luminescence sustain period of each field, and as long as the initialization period is provided immediately after the subfield with large weight, the same effect is achievable.

INDUSTRIAL APPLICABILITY

As described above, the write operation can take place correctly in all discharge cells without deteriorating the contrast even if discharge interference occurs between adjacent cells or a subfield with small weight is disposed far timewise from the initialization period. Accordingly, the present invention is effective for improving the display quality of the plasma display device.

The invention claimed is:

1. A plasma display device comprising:

a plasma display panel in which a discharge cell is formed at an intersection of a scan electrode and a sustain electrode disposed in parallel and a data electrode disposed orthogonal to the scan electrode and the sustain electrode; and a scan drive circuit for applying a voltage waveform to the scan electrode;

wherein one field comprises a plurality of subfields including at least a luminescence sustain period and a write period, the one field includes at least one set of successive two subfields including a predetermined subfield and a preceding subfield followed by the predetermined subfield, the predetermined subfield has a smaller number of sustain pulses than that of the preceding subfield, a number of sustain pulses applied to the discharge cell of each subfield from a beginning subfield to the preceding subfield followed by the predetermined subfield of the one field is gradually larger than a number of sustain pulses of a preceding subfield, a number of sustain pulses applied to the discharge cell of each subfield from the predetermined subfield to the last subfield of the one field following the predetermined subfield of the one field is gradually larger than a number of sustain pulses of a preceding subfield, the scan drive circuit applies, in the one field, only a first initialization waveform in an initialization period of the subfield having the smallest number of sustain pulses and only a second initialization waveform in an initialization period of the predetermined subfield, and a peak voltage of the first initialization waveform applied to the subfield having the smallest number of sustain pulses is higher than a peak voltage of the second initialization waveform applied to the predetermined subfield.

2. The plasma display device of claim 1, wherein each of a voltage of the first initialization waveform and a voltage of the second initialization waveform is determined by an average luminance level of input picture signal.

3. The plasma display device of claim 2, further comprising an initialization voltage determination unit for determining the voltage of the first initialization waveform and the voltage of the second initialization waveform based on the average luminance level of input picture signal.

4. The plasma display device of claim 1, wherein the subfield having the smallest number of sustain pulses, excluding the predetermined subfield, is a first subfield in the one field.

5. The plasma display device of claim 1, wherein a voltage of the first initialization waveform increases gradually toward the peak voltage of the first initialization waveform, and a voltage of the second initialization waveform increases gradually toward the peak voltage of the second initialization waveform.

6. The plasma display device of claim 1, wherein a voltage of the first initialization waveform increases in a positive direction toward the peak voltage of the first initialization waveform, and a voltage of the second initialization waveform increases in a positive direction toward the peak voltage of the second initialization waveform, and wherein the voltage of the first initialization waveform includes a positive voltage being retained for all sustain electrodes, and a lamp voltage, which gradually decreases toward a voltage above a discharge start voltage with respect to all sustain electrodes, being applied to all scan electrodes.

* * * * *